United States Patent [19]

Gray et al.

[11] Patent Number: 4,637,282

[45] Date of Patent: Jan. 20, 1987

[54] METHOD OF MAKING CLEAR DIES FROM BAR STOCK

[76] Inventors: Frank Gray, 3146 Lin-Tel Rd., St. Louis, Mo. 63125; Clyde M. Hardin, Jr., 1400 S. Main St., DeSota, Mo. 63020

[21] Appl. No.: 599,963

[22] Filed: Apr. 13, 1984

[51] Int. Cl.[4] ..... B21K 5/20

[52] U.S. Cl. ..... 76/4; 76/107 C; 72/389; 72/412

[58] Field of Search ..... 76/107 C, 107 R, 101 R, 76/4; 72/389, 412, 409, 407

[56] References Cited

U.S. PATENT DOCUMENTS

| | | | |
|---|---|---|---|
| 922,926 | 5/1909 | Lynch | 76/107 C |
| 1,837,524 | 12/1931 | Braden | 76/107 C |
| 2,281,587 | 5/1942 | Latham | 76/107 C |

FOREIGN PATENT DOCUMENTS

| | | | |
|---|---|---|---|
| 304023 | 2/1918 | Fed. Rep. of Germany | 72/412 |
| 950424 | 3/1949 | France | 76/107 C |

*Primary Examiner*—Roscoe V. Parker

[57] ABSTRACT

A method and apparatus for making cutting dies having sidewalls diverging from the cutting edge from thin bar stock having an internal side and an external side. A section of bar stock is cut at least as long as the perimeter of the die. Starting at one end the section is successively bent and advanced according to a pattern, making internal bends between a first set of tools and external bends between a second set of tools. The first set of tools, has a female tool with a sloping surface supporting the external side of the bar stock with the cutting edge pointed outwardly, and a tapering slot, and a male tool, having a sloped bending-edge aligned with the slot in the female tool for pushing the bar stock into the slot and bending it. The second set of tools, has a female tool with a sloping surface for supporting the internal side of the bar stock with the cutting edge pointed inwardly, and a tapering slot, and a male tool, having a sloped bending-edge aligned with the slot in the female tool for pushing the bar stock into the slot, and bending it.

12 Claims, 11 Drawing Figures

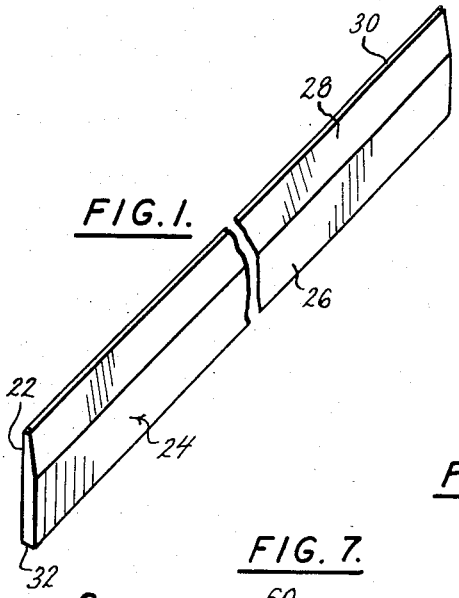
FIG. 1.
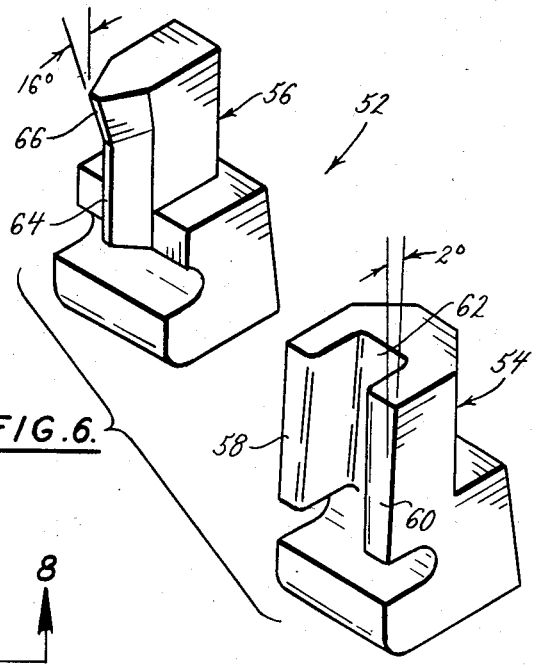
FIG. 6.
FIG. 7.
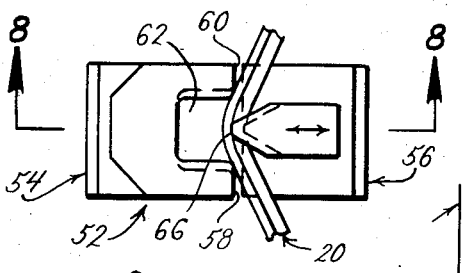
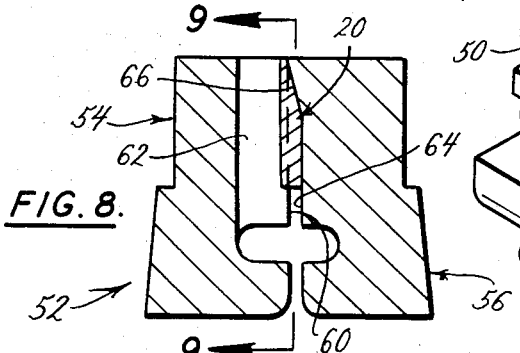
FIG. 8.
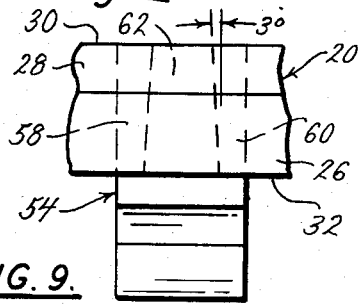
FIG. 9.
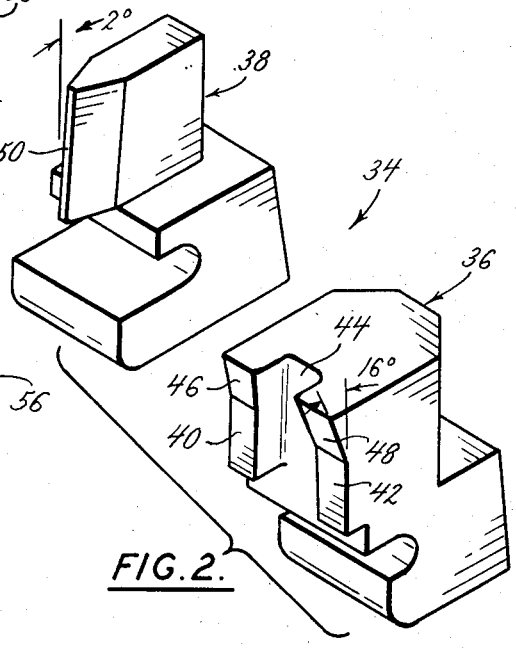
FIG. 2.

METHOD OF MAKING CLEAR DIES FROM BAR STOCK

BACKGROUND AND SUMMARY OF THE INVENTION

This invention relates to die cutting and in particular to a method of making, and the tools for making, clear dies having internal sidewalls that diverge from the cutting edge, out of bar stock.

Cutting dies have been used for a long time to cut pieces from sheet material. Many of these dies are not clear, that is they have internal crossbracing to stiffen the die and help it maintain its shape. However, these cross braces prevent the cut pieces from passing through the dies. Thus, the cut pieces had to be removed, or stripped, from the die between cutting operatings. This impedes the productivity of the die and requires special equipment and/or extra labor to service the die. Various stripping devices have been developed, but they require further equipment to handle the cut pieces removed from the dies.

It is desirable to have the cut pieces pass through the die, but this is difficult even in a clear die without internal cross-bracing because the vertical die walls do not readily permit passage of the cut pieces. To alleviate this problem, the internal side walls of the die can be made so that they diverge from the cutting edge, permitting the cut pieces to travel through the die and out where they can be conveniently collected without interfering with the operation of the die. The difficulty with this solution has been in manufacturing a clear die to the desired shape while maintaining the diverging configuration of the sidewalls. Such dies have been made by forging or casting, but the dies are extremely expensive. An inexpensive method of making a die of any shape where the sidewalls diverge from the cutting edge was not available, and thus such dies were not available to many industries where they could be used to great advantage. For example, in the shoe industry as many as 40 different dies are needed to make soles for the entire size range in just one style. The cost of making clear diverging dies has thus been exhorbitant.

The present invention is a method of making, and the tools for making, clear dies having sidewalls that diverge from the cutting edge, out of barstock. The resulting dies differ from prior dies, even prior dies that may have been constructed from bar stock, because they are clear, without any internal bracing, yet they have diverging sidewalls facilitating the throughput of cut pieces. Because the die is made from bar stock it is more quickly and inexpensively fabricated than prior art dies with diverging sidewalls.

The dies are made from thin bar stock with wide sides, the bar stock having an internal side that is flat, for the interior of the die, and an external side that is flat for a portion and then tapers inwardly to form a cutting edge. The method comprises cutting a section of bar stock to the approximate perimeter of the die, and, starting at one end, successively bending and advancing the section according to a pattern to shape the die. The bends are made with one of two sets of male and female tools, a first set for making internal bends toward the center of the die, and a second set for making external bends away from the center of the die.

The first set of tools comprises a female tool having two lands for supporting the external side of the bar stock, the lands sloping so that the cutting edge on the bar stock points away from the female tool, the lands converging toward the cutting edge on the bar stock. The lands are separated by a vertical tapering slot. The first set of tools also comprises a male tool that has a bending-edge aligned with the slot in the female tool and sloped generally in the same direction as the lands. The bending-edge is straight and engages the internal side of the bar stock. The male tool is operated to push the bar stock into the slot, bending the bar stock between the lands. The diverging configuration of the die walls is maintained because the bar stock is held at an angle as it is bent. Further, consistent with the desired diverging configuration of the walls, the bend sharpens toward the cutting edge because of the converging configuration of the lands.

The second set of tools comprises a female tool having two lands for supporting the internal side of the bar stock, the lands sloping so that the cutting edge on the bar stock points toward the female tool, the lands converging toward the cutting edge on the bar stock. The lands are separated by a vertical tapering slot. The second set of tools also comprises a male tool that has a bending-edge aligned with a slot in the female tool and sloped generally in the same direction as the lands. The bending-edge engages the external side of the bar stock. The male tool is operated to push the bar stock into the slot in the female tool, bending the bar stock between the lands. The diverging configuration of the die walls is maintained because the bar stock is held at an angle as it is bent. Further, consistent with the diverging configuration of the die walls, the bend sharpens toward the cutting edge because of the converging configuration of the lands.

The new method further comprises trimming the section upon completion of the shaping operations, and joining the ends together to form a complete die. The cutting edge of the die can then be sharpened and the opposite edge can be ground flat to eliminate any irregularities. The die can also be heat treated, if desired.

BRIEF DESCRIPTION OF THE DRAWINGS

FIG. 1 is an orthogonal view of a section of bar stock from which dies are made according to the method of this invention;

FIG. 2 is an orthogonal view of the first set of tools of this invention, used in the method of this invention to make internal bends in the bar stock to shape the dies;

FIG. 6 is an orthogonal view of the second set of tools used to make external bends in the bar stock to shape the die;

FIG. 7 is a top view of the second set of tools as they would be used to make an external bend in bar stock;

FIG. 8 is a cross-sectional view of the second set of tools taken along the plane of line 8—8 in FIG. 7;

FIG. 9 is a cross-sectional view of the second set of tools taken along the plane of line 9—9 in FIG. 8;

DETAILED DESCRIPTION OF THE PREFERRED EMBODIMENT

Figure 3:
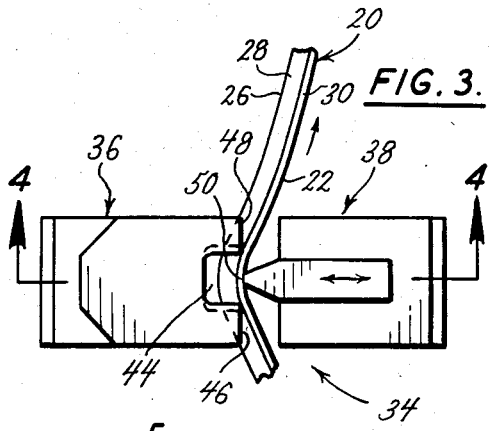
FIG. 3 is a top view of the first set of tools as they would be used to make an internal bend in bar stock.
Figure 4:
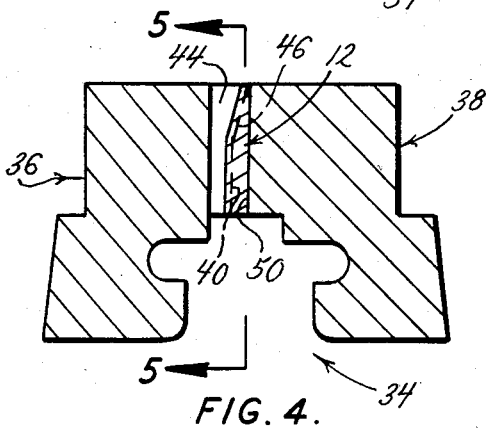
FIG. 4 is a cross-sectional view of the first set of tools taken along the plane of line 4—4 in FIG. 3.

FIG. 1 shows a section of bar stock 20 suitable for use with the tools of this invention and preferably used in the method of this invention. Bar stock 20 has an internal side 22 that is flat. Opposite internal side 22 is external side 24 that has a flat portion 26 and an inwardly tapering portion 28 which forms cutting edge 30. Portion 28 preferably tapers inwardly at an angle of about 18°. Opposite cutting edge 30 is back 32.

Figure 5:
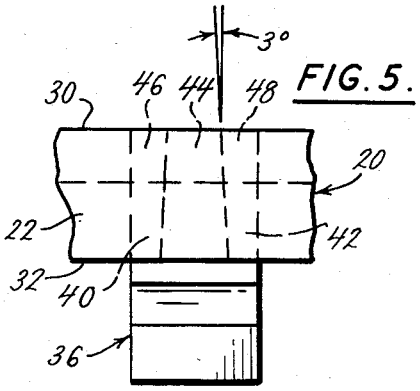
FIG. 5 is a cross-sectional view of the first set of tools taken along the plane of line 5—5 in FIG. 4.

FIG. 2 shows the first set of tools 34, used in the method of this invention to make internal bends in the bar stock to shape the die. Internal bends are bends toward the center of the die, made on the internal side of the bar stock. Set 34 comprises female tool 36 and male tool 38. Female tool 36 has two lands 40 and 42 sloping upwardly and forwardly. In the preferred embodiment, lands 40 and 42 slope at an angle of about 2°. Each land 40 and 42 converges upwardly toward the other. In the preferred embodiment, each land converges toward the other at an angle of about 3°, as best shown in FIG. 5. An upwardly tapering vertical slot 44 separates lands 40 and 42, the taper in slot 44 caused by the convergence of lands 40 and 42.

Lands 40 and 42 form an upwardly, forwardly sloped face for supporting the external side of the bar stock. The face is actually a compound surface, as the upper portions 46 and 48 of lands 40 and 42, respectively, slope sharply forward at an angle relative to the rest of the land that is complementary to the taper on the external side of the bar stock in the preferred embodiment. The angle of the forward slope of portion 46 and 48 is 18° with respect to lands 40 and 42, and 16° with respect to vertical. Portions 46 and 48 form wedge shaped supports for engaging the tapered portions on the external side of the bar stock.

The male tool 38 comprises a straight bending-edge 50. Bending-edge 50 slopes upwardly and rearwardly so that in the operation of male tool 38 against female tool 36, the bending-edge 50 slopes generally in the same direction as lands 40 and 42. In the preferred embodiment, bending-edge 50 slopes at an angle of about 3°, greater than the slope of lands 40 and 42. Straight bending-edge 50 engages the flat, internal side of the bar stock.

In operation, bending-edge 50 is aligned with slot 44 in female tool 36. The male tool 38 is operated against the female tool 36 to push the bar stock into slot 44, thereby bending the bar stock between lands 40 and 42. The sloped configuration of the tools forms the bend in the bar stock while maintaining the diverging configuration. The sharpness in the bend increases upwardly toward the cutting edge, consistent with the desired divergent configuration of the sidewalls, because of the convergence of lands 40 and 42.

In the preferred embodiment, the tools are arranged to bend the bar stock with the cutting edge up. However, based upon this disclosure, it is apparent to one skilled in the art that the tools can also be constructed so that the bar stock is bent with the cutting edge down. For making internal bends, the male tool must engage the internal side of the bar stock; regardless of which direction the lands and edge slope, the bar stock must be placed on the female tool so that the cutting edge points outwardly from the female tool and toward the male tool; and, the lands in the female tool must converge towards each other toward the cutting edge of the bar stock as the bar stock is supported on the female tool.

FIG. 6 shows the second set of tools 52, used in the method of this invention to make external bends in bar stock to shape the die. External bends are bends away from the center of the die, made on the external side of the bar stock. Set 52 comprises female tool 54 and male tool 56. Female tool 54 has lands 58 and 60 sloping upwardly and rearwardly. In the preferred embodiment, lands 58 and 60 slope at an angle of about 2°. Each land 56 and 58 converges upwardly toward the other. In the preferred embodiment, each land converges toward the other at an angle of about 3°, as best shown in FIG. 9. An upwardly tapering vertical slot 62 separates lands 58 and 60, the taper in slot 62 caused by the convergence of lands 58 and 60. Lands 58 and 60 form an upwardly, rearwardly sloped face for engaging the internal side of the bar stock.

The male tool 56 comprises a bending-edge 64. Bending-edge 64 slopes upwardly and forwardly, so that in the operation of male tool 56 against female tool 54, bending-edge 64 slopes generally in the same direction as lands 58 and 60. In the preferred embodiment, bending-edge 64 slopes at an angle of 3°, greater than the slope of lands 58 and 60. Bending-edge 64 engages the external side of the bar stock. The edge is actually a compound surface, as the upper portion 66 of bending-edge 64 slopes sharply forward at an angle relative to the rest of the edge that is complementary to the taper on the external side of the bar stock in the preferred embodiment. The angle of the forward slope of portion 66 is 18° with respect to edge 64, and 16° with respect to vertical. Portion 66 forms a wedge shaped support for engaging the tapered portion on the external side of the bar stock.

In operation, bending-edge 64 is aligned with slot 62 in female tool 54. Male tool 56 is operated against female tool 54 to push the bar stock into slot 62, thereby bending the bar stock between lands 58 and 60. The sloped configuration of the tools forms the bend in the bar stock while maintaining the diverging configurations. The sharpness of the bend increases upwardly toward the cutting edge, consistent with the desired diverging configurations of the sidewalls, because of the convergence of lands 58 and 60.

In the preferred embodiment, the tools are arranged to bend the bar stock with the cutting edge up. Based upon this disclosure it is obvious to one skilled in the art that the tools can be constructed so that the bar stock is bent with the cutting edge down. For making external bends, the male tool must engage the external side of the bar stock; regardless of which direction the lands and edge are sloped, the bar stock must be placed on the female tool so that the cutting edge points inwardly toward the female tool and outwardly from the male tool; and the lands in the female tool must converge towards each other toward the cutting edge of the bar stock as the bar stock is placed on the female tool.

The method of making clear dies with sidewalls that diverge from the cutting edge of this invention comprises cutting a section of bar stock, such as bar stock 20, to a length at least as great as the perimeter of the die to be constructed. The section of bar stock is oriented with the cutting edge 30 up, with internal side 22 of bar stock 20 for forming the interior of the die and the exterior sides 24 of bar stock 20 for forming the exterior of the die. A pattern of the die to be constructed is affixed to the internal side 22 of bar stock 20 at the cutting edge 30, at one end of the section of bar stock. Starting at this end of the section bar stock, bar stock 20 is successively bent and advanced according to the pattern, to shape the die. Internal bends, or bends in the internal side 22 of the bar stock 20 are made with the first set of tools 34. External bends, or bends in the external side 26 of bar stock 20 are made with the second set of tools 52.

In making internal bends, the bar stock 20 is placed on the female tool 36 with external side 24 against lands 40 and 42. The flat portion 26 of bar stock 20 is engaged by lands 40 and 42 and the tapering portion 28 of bar stock 20 is engaged by the wedge shaped supports formed by portions 46 and 48 on lands 40 and 42, respectively.

As best shown in FIG. 3, the bending-edge 50 of male tool 38 is aligned with slot 44 in female tool 36. As shown in FIG. 8, bending-edge 50 is urged into engagement with internal side 22 of bar stock 20. Further action of male tool 38 against female tool causes bending-edge 50 to push bar stock 20 into slot 24 causing it to bend between lands 40 and 42. The sloped configuration of bending-edge 50 and lands 40 and 42 maintains the diverging configuration of the sidewalls because bar stock 20 is held at a diverging angle as it is being bent. The sharpness of the bend increases upwardly toward the cutting edge 30 because lands 40 and 42 converge toward the top. This sharpening of the bend is consistent with the diverging configuration of the die walls. The bar stock is advanced slightly, and bent again, according to the pattern, until the internal curve is completed.

In making external bends, the bar stock 20 is placed on the female tool 54, with internal side 22 against lands 58 and 60. Flat side 22 of bar stock is fully supported by sloping lands 58 and 60. As best shown in FIG. 3, the bending-edge 64 of male tool 58 is aligned with slot 62 in female tool 54. Bending-edge 64 is urged into engagement with the external side 24 of bar stock 20. The flat portion 26 of bar stock 20 is engaged by bending-edge 64 and the tapering portion 28 of bar stock 20 is engaged by the wedge shaped support formed by portion 66 of bending-edge 64. Further action of male tool 58 against female tool 56 causes bending-edge 64 to push bar stock 20 into slot 62, causing bar stock 20 to bend between lands 58 and 60. The slope configuration of bending-edge 64 and lands 58 and 60 maintain the diverging configuration of the sidewalls because bar stock 20 is held at a diverging angle as it is being bent. The sharpness of the bend increases upwardly toward the cutting edge 30 because lands 58 and 60 converge towards the top. This sharpening of the bend is consistent with the desired converging shape of the die. The bar stock 20 is advanced slightly, and bent again according to the pattern until the external curve is completed.

After the bar stock is bent to conform to the pattern, the bar stock is trimmed to remove any excess material and the ends are aligned and joined together. This joining can be by welding or any other suitable technique. If necessary or desired the joint can be ground flat. Once the ends are joined, the die may be leveled, the back 32 of the bar stock 30 now forming the back of the die, can be machined flat, to eliminate irregularities at the joint and to eliminate any twisting in the back. Cutting edge 30 on bar stock 20 can then be sharpened, for example, by grinding. The completed, sharpened die can be put into service or may be heat treated for hardening before being put into service. A typical heat treating process would be heating the die and quenching it in oil. The operating temperatures of the process depend on the particular material. To prevent warping of the die, the die can be compressed between two plates before and during the quenching.

Figure 10:
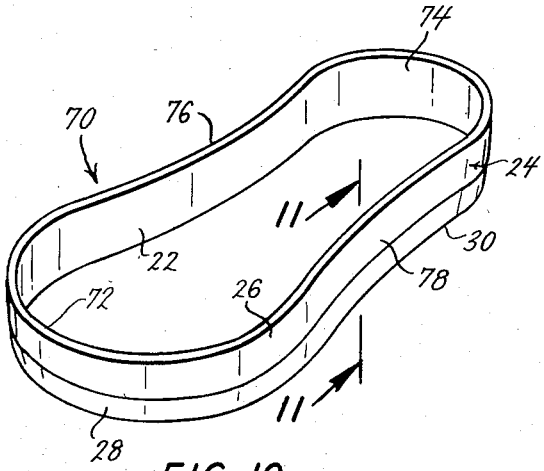
FIG. 10 is an orthogonal view of a die constructed according to the method of this invention.
Figure 11:
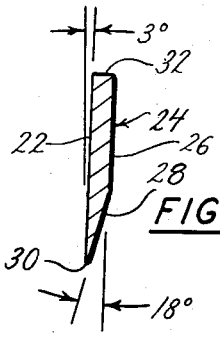
FIG. 11 is a cross-sectional view of the die taken along the plane of line 11—11 in FIG. 10.

FIG. 10 shows an example of the completed die 70 constructed according to the method and with the tools of this invention. Die 70 has two internal curves 72 and 74 and two external curves 76 and 78. As seen in the cross-sectional view of die 70 in FIG. 11, the die walls diverge from cutting edge 30 at a small angle, about 3°, equivalent to the slope of the male tool.

There are various changes and modifications which may be made to applicant's invention as would be apparent to those skilled in the art. However, any of these changes or modifications are included in the teaching of applicant's disclosure and he intends that his invention be limited only by the scope of the claims appended hereto.

We claim:

1. A set of tools for making bends in thin bar stock with wide sides, the tools comprising a female tool having a sloped face for supporting the bar stock and a vertical tapering slot in the face, and a male tool having a sloped bending-edge aligned with the slot to push the bar stock into the slot and bend the bar stock.

2. The set of tools of claim 1 wherein one of the tools has a compound forming surface for engaging the bar stock.

3. The set of tools of claim 1 for bending bar stock that has an inward taper on one side forming a cutting edge at one edge, wherein the female tool supports the tapering side of the bar stock with the cutting edge pointed outwardly, and the slot tapers toward the cutting edge.

4. The set of tools of claim 1 for bending bar stock that has an inward taper one side forming a cutting edge at one edge, wherein the female tool supports the side of the bar stock opposite the taper with the cutting edge pointed inwardly, and the slot tapers toward the cutting edge.

5. A set of tools for making internal bends in thin bar stock with wide sides, the bar stock having a flat internal side and an external side with an inward taper to form a cutting edge, the tools comprising:

a female tool comprising two sloped lands for supporting the external side of the bar stock with the cutting edge pointing outwardly from the female tool, the lands converging towards each other toward the cutting edge on the bar stock, and a tapering vertical slot separating the lands; and, a male tool for operating against the female tool comprising a bending-edge sloped in the same direction as the lands for engaging the internal side of the bar stock, the edge aligned with the slot in the female tool for pushing the bar stock into the slot thereby bending it between the lands, the sharpness in the bend increasing towards the cutting edge because of the converging configuration of the lands.

6. The set of tools of claim 5 wherein each land on the female tool has a raised ramp-like support positioned to engage the taper on the bar stock.

7. The set of tools of claim 6 wherein the bending-edge of the male tool slopes at a greater angle with respect to vertical than the lands of the female tool.

8. The set of tools of claim 6 wherein the lands of the female tool slope upwardly and forwardly; the lands converge upwardly, and the bending-edge of the male tool slopes upwardly and rearwardly.

9. A set of tools for making external bends in thin bar stock with wide sides, the bar stock having a flat internal side and an external side with an inward taper to form a cutting edge, the tools comprising;

a female tool comprising two sloped lands for supporting the internal side of the bar stock with the cutting edge pointing inwardly toward the female tool the lands converging towards each other toward the cutting edge on the bar stock, and a tapering vertical slot separating the lands; and, a male tool for operating against the female tool comprising a bending-edge sloped in the same direction as the lands for engaging the external side of the bar stock, the edge aligned with the slot in the female tool for pushing the bar stock into the slot thereby bending it between the lands, the sharpness in the bend increasing toward the cutting edge because of the converging configuration of the lands.

10. The set of tools of claim 5 wherein the bending-edge of the male tool has a raised ramp-like support positioned to engage the taper on the bar stock.

11. The set of tools of claim 10 wherein the bending-edge of the male tool slopes at a greater angle with respect to vertical than the lands of the female tool.

12. The set of tools of claims 10 wherein the lands of the female tool slope upwardly and rearwardly; the lands converge upwardly; and the bending-edge of the male tool slopes upwardly and forwardly.

* * * * *